US005688184A

United States Patent [19]

Johnson

[11] Patent Number: 5,688,184

[45] Date of Patent: Nov. 18, 1997

[54] GOLF SWING TRAINER

[75] Inventor: Dennis Neal Johnson, Federal Way, Wash.

[73] Assignee: Trio Johnson, Inc., Federal Way, Wash.

[21] Appl. No.: 680,861

[22] Filed: Jul. 16, 1996

[51] Int. Cl.[6] ..... A63B 69/36

[52] U.S. Cl. ..... 473/229; 482/109; 482/124; 473/208

[58] Field of Search ..... 473/229, 207, 473/208, 274; 482/109, 124

[56] References Cited

U.S. PATENT DOCUMENTS

| | | | |
|---|---|---|---|
| 1,459,705 | 6/1923 | Bullock . | |
| 2,461,826 | 2/1949 | Krautter . | |
| 2,498,006 | 2/1950 | Ridill . | |
| 2,528,077 | 10/1950 | Pond . | |
| 3,059,932 | 10/1962 | Smallwood . | |
| 3,346,257 | 10/1967 | Whitney . | |
| 3,408,078 | 10/1968 | Falerni et al. . | |
| 3,442,513 | 5/1969 | Fisher . | |
| 3,595,583 | 7/1971 | Oppenheimer | 273/191 R |
| 3,677,551 | 7/1972 | Schaus | 273/183 B |
| 3,713,657 | 1/1973 | Presta | 273/190 R |
| 3,861,688 | 1/1975 | Butler | 273/183 B |
| 3,937,465 | 2/1976 | Roland | 473/229 X |
| 4,034,991 | 7/1977 | Oppenheimer | 273/186 A |
| 4,134,589 | 1/1979 | Arena | 273/183 B |
| 4,399,994 | 8/1983 | Hourihan | 273/191 R |
| 4,582,325 | 4/1986 | Yuhara | 273/186 A |
| 5,149,099 | 9/1992 | Radakovich | 273/189 R |
| 5,150,901 | 9/1992 | Stawicki | 473/229 X |
| 5,174,564 | 12/1992 | Young, III | 273/26 C |
| 5,295,690 | 3/1994 | Johnson | 273/187.2 |
| 5,342,055 | 8/1994 | Diley | 273/187.2 |

*Primary Examiner*—George J. Marlo

*Attorney, Agent, or Firm*—David P. Campbell; Glenn D. Bellamy

[57] ABSTRACT

A golf swing training device (10) including a grip (12), an elastic cord loop (14), a neck pad (16) and an adjustment mechanism (18). Grip (12) is in the form of a conventional golf club grip. The elastic cord loop (14) is secured at the narrow end of grip (12). Adjustment mechanism (18) allows the length of cord loop (14) to be selectively adjusted for a particular golfer. Neck pad (16) includes straps (50), through which cord loop (14) is inserted. Neck pad (16) doubles as a carrying case for the grip and cord loop. Neck pad (16) includes a sleeve (66), closed at one end by a flap (60). The method of improving a golfer's swing, comprising the steps of gripping the grip, extending the elastic cord loop around a golfer's neck, attaching the ends of the cord loop to one end of the grip, holding the grip at an address position, with the elastic cord loop attached at the lower end of the grip, and with the elastic cord loop having sufficient tension to resist further movement of the lower end of the grip away from the golfer's head, and simulating the portion of a golf swing before and after impact where the wrists of the golfer release, in a manner that the elastic cord loop retains tension throughout the swing.

7 Claims, 3 Drawing Sheets

FIG. 4
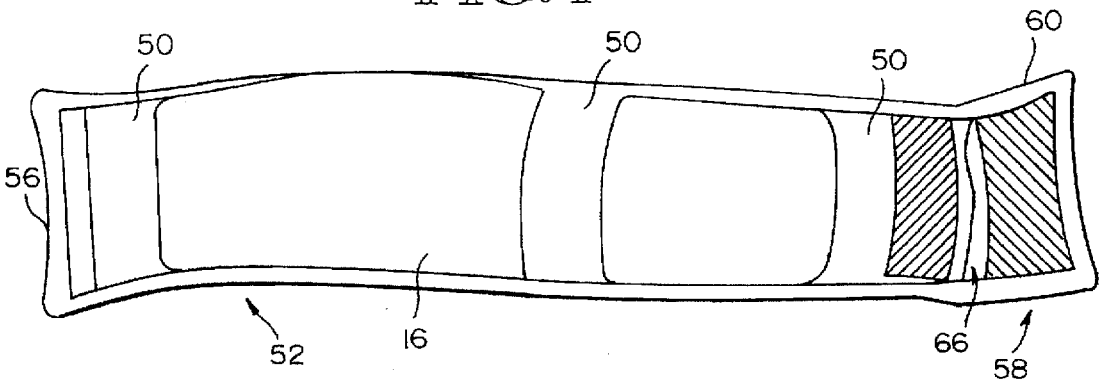
FIG. 2
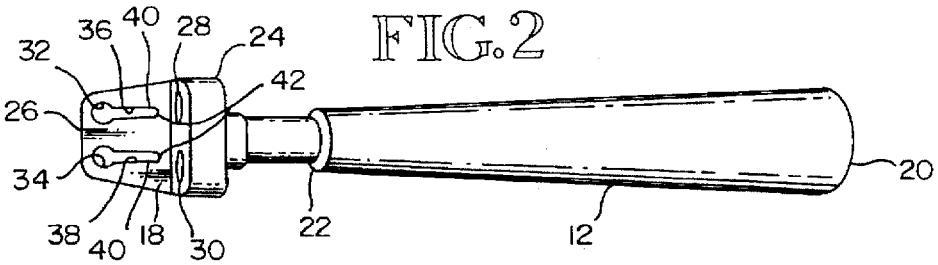
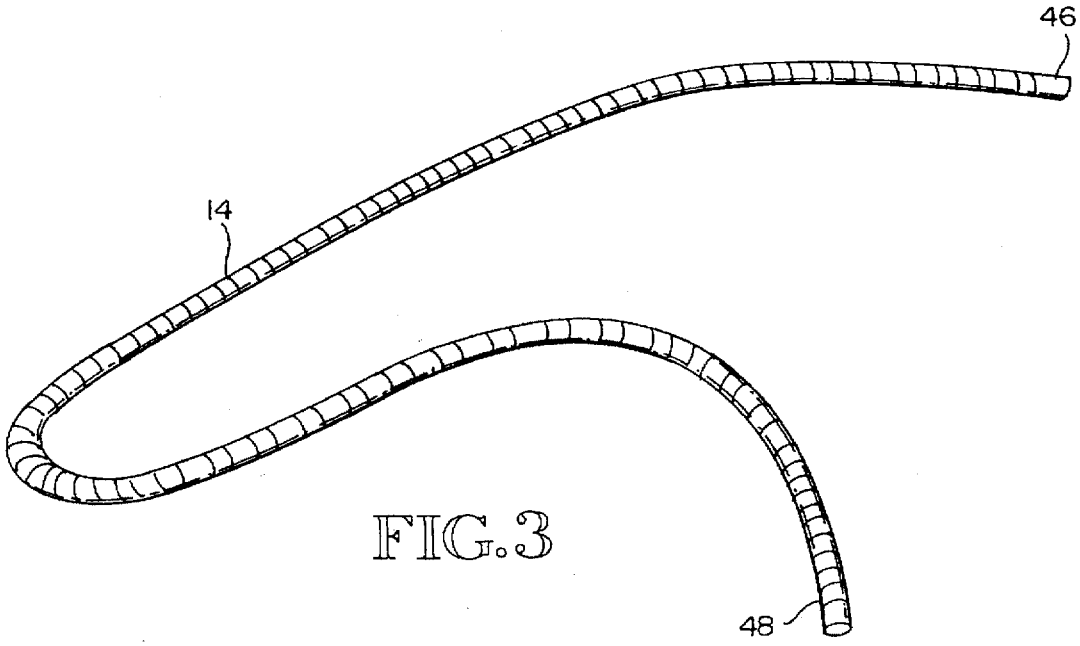
FIG. 3

FIG. 5
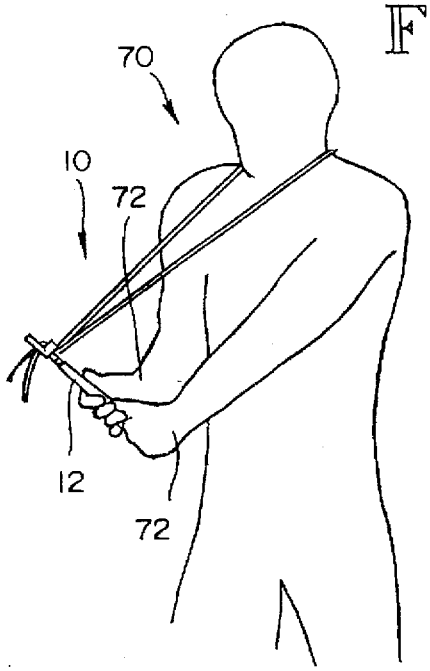
FIG. 6
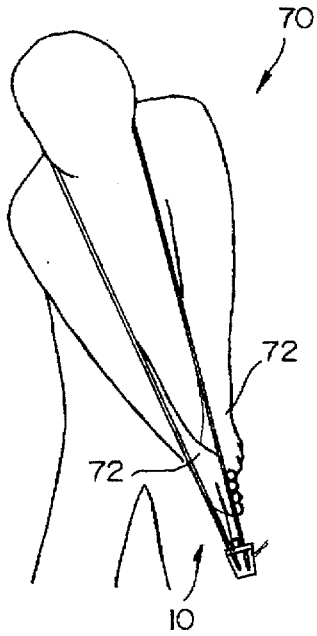
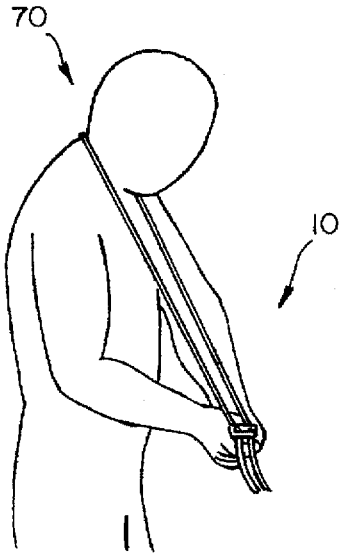
FIG. 7
FIG. 8
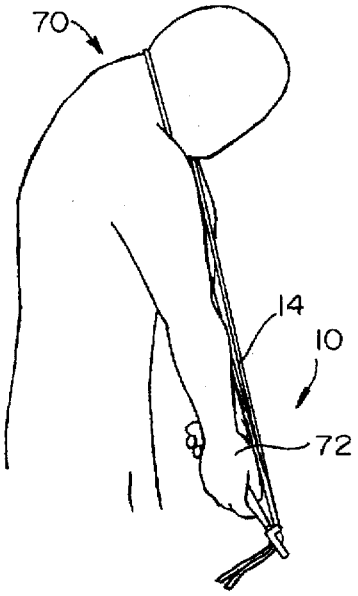

GOLF SWING TRAINER

TECHNICAL FIELD

The present invention relates to devices for use by golfers to improve their swings, and more particularly, to improve their wrist action during a swing.

BACKGROUND OF THE INVENTION

Golf perhaps more than any other sport has more patents issued for devices and equipment all designed to improve some aspect of the game. Golf devices have been created to improve a golfer's consistency, accuracy, touch, rhythm, tempo, timing, swing plane, power, fade and draw control, trajectory, spin, tension, grip pressure, and ability to cope with weather conditions, to name just a few. The present invention falls into the category of improving a golfer's power, but due to the interrelatedness of some of the foregoing aspects of the game, the present invention should also improve a golfer's swing plane, rhythym and tempo, and perhaps some other aspects of a player's game as well.

DISCLOSURE OF THE INVENTION

Briefly described, the present invention is a golf swing training device that comprises a grip generally in the form of a golf club grip and an elastic cord loop attached to a lower end of the grip. The elastic cord loop has sufficient flexibility and length to extend around a golfer's neck, while the grip is held by the golfer's hand in an address position with the lower end of the grip pointing downwardly away from the golfer. The elastic cord loop also has sufficient resiliency to create tension in the cord loop, which tension the golfer's hands must work against as the device is utilized to simulate wrist action during a golf swing.

Preferably, the grip is tapered and includes a wider end and a narrower end, the elastic cord loop being attached to the narrower end. The device could also include a full length golf club, with the cord loop attached where the grip meets the shaft. However, it is not necessary to have a full length golf club to practice the present invention.

According to an aspect of the invention, the golf swing training device further comprises an adjustment mechanism mounted at the lower end of the grip. The adjustment mechanism allows the cord loop length to be selectively adjusted for the arm length of a particular golfer. Preferably, the adjustment mechanism includes a pair of narrow slots sized slightly smaller than the thickness of the cord loop. The cord loop having ends that are each adapted to be wedged into a slot for securing the cord loop to the adjustment mechanism.

According to another aspect of the invention, the golf swing training device further comprises a neck pad. The elastic cord loop is inserted through straps in the neck pad and secured to the adjustment mechanism. The neck pad is in the form of a sleeve, one side of which is padded and the other side of which includes the straps for the cord loop. The grip and cord loop are stored in the sleeve. This allows the device to be easily carried and/or stored when not in use.

The present invention also includes a method of improving a golfer's swing. The method comprises the steps of gripping the golf club grip and extending the elastic cord loop around a golfer's neck. Then the ends of the cord loop are adjusted, if necessary, according to the length of the golfer's arms. With the elastic cord loop attached at the lower end of the grip, the golfer simulates the portion of a golf swing before and right after impact, the portion of the swing where the golfer's wrists release. It is important that tension be maintained in the cord loop throughout the swing. The idea is for the golfer to delay uncocking of his wrist's until his hips have cleared, right before impact.

Preferably, according to the method of practicing the invention, the golfer maneuvers the grip through the swing in a manner that the elastic cord loop crosses over the golfer's wrists in close proximity thereto or by actually grazing the wrists with the cord loop. In this manner, the golfer practices bringing the club from the inside to the point of impact, which ensures a swing plane that is more parallel with the target line.

These and other features, advantages, and objects of the present invention will become more apparent from the following detailed description of the best mode, when read in conjunction with the drawings and the claims, which are all incorporated herein by reference.

BRIEF DESCRIPTION OF THE DRAWINGS

In the drawings, like reference numerals refer to like parts throughout the several views, wherein:

FIG. 2 is a plan view of the grip component and adjustment mechanism of the golf swing trainer of FIG. 1;

FIG. 3 is a pictorial view of the elastic cord loop of the golf swing trainer of FIG. 1;

FIG. 4 is a pictorial view of the neck pad of the golf swing trainer of FIG. 1;

FIG. 5 is a front view of a golfer shown using the golf swing trainer of FIG. 1, the position shown being that of the golfer prior to impact position;

FIG. 6 is a front view of the golfer of FIG. 5, shown immediately after impact position;

FIG. 7 is a side view of the golfer of FIG. 5, shown at approximately the same position prior to impact; and FIG. 8 is a side view of the golfer of FIG. 6, shown at approximately the same position just after impact position.

BEST MODE FOR CARRYING OUT INVENTION

Figure 1:
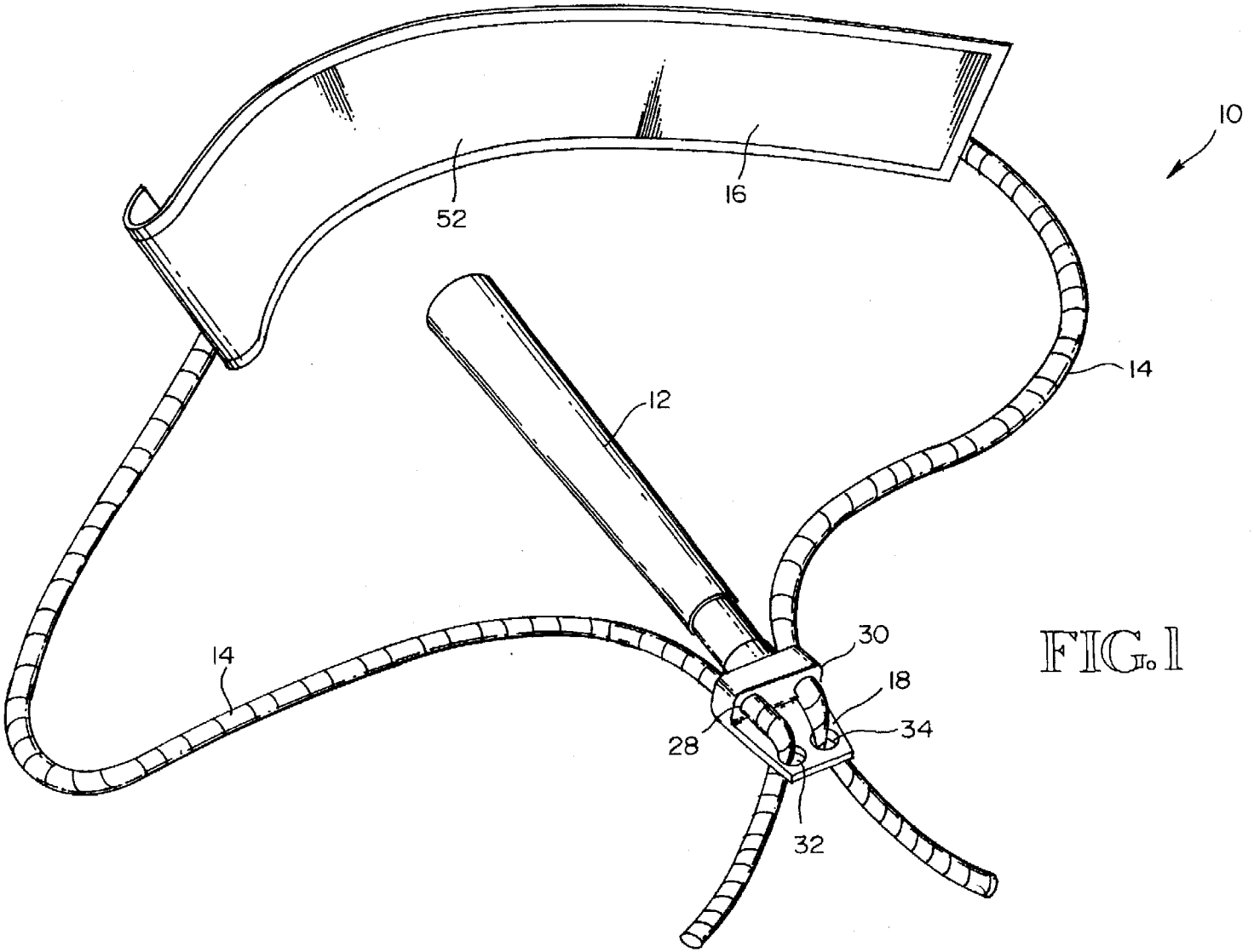
FIG. 1 is a pictorial view of the golf swing trainer of the present invention.

Referring to FIGS. 1–4, the present invention comprises a golf swing training device 10 that includes a grip 12, an elastic cord loop 14, a neck pad 16, and an adjustment mechanism 18. Grip 12 is shaped in the form of a conventional golf club grip. Grip 12 has a wide end 20, a narrow end 22, and is tapered therebetween. When grip 12 is held by a golfer in a conventional address position, narrow end 22 becomes a "lower" end of the club in that it is below the golfer's hands and is farther away from the golfer.

Adjustment mechanism 18 is secured to the lower end 22. Adjustment mechanism 18 is L-shaped with a first leg 24 and a second leg 26. First leg 24 includes two openings 28, 30, and second leg 26 includes a pair of corresponding openings 32, 34. Each opening 32, 34 has associated with it an incrementally narrowed slot 36, 38. A shoulder 40 is defined in each slot 36, 38, and each slot 36, 38 has a rounded closed end 42. The design of slots 36, 38 can vary from that shown. For example, the slots can be V-shaped. Other slot designs should be apparent to those skilled in the art. All that is necessary in the design of slots 36, 38 is that they are able to hold the end portions of cord loop 14, yet allow the cord loop ends to be removed, either to readjust the cord loop length or to store the device.

The elastic cord loop 14 preferably is of a bungee cord construction, but any type of flexible cord having sufficient elasticity and durability would work satisfactory with the present invention. Cord loop 14 is not actually a "loop" until the end portions 46, 48 of cord loop 14 are secured into slots 36, 38. Each end 46, 48 is designed to be inserted first through one of openings 28, 30, then through a corresponding opening 32, 34, as shown in FIG. 1. Opening 28 corresponds with opening 32, and opening 30 corresponds with opening 34. With each end portion of cord loop 14 inserted through the openings, the end portions are then wedged down into slots 36, 38, past shoulders 40 and into the rounded closed ends 42. The shoulders 40, as well as the narrowness of slots 36, 38, function to hold the wider end portions of cord loop 14 within the slots.

Neck pad 16 is an elongated, padded band that has a set of three straps 50 through which cord loop 14 is inserted. Straps 50 are on the side of neck pad 16 opposite the pad's padded side 52. Neck pad 16 doubles as a carrying case for elastic cord loop 14 and grip 12. Neck pad 16 has a closed end 56 and an open end 58. The back and front sides of neck pad 16 form a sleeve 66. A flap 60 at open end 58 is folded and secured to the sleeve portion of neck pad 16 by a mechanical fastener, such as a Velcro-type fastener. When the swing training device of the present invention is not is use, grip 12 and cord loop 14 are slipped into sleeve 66 and flap 60 is closed. With the grip and cord stowed in the sleeve of the neck pad, the device is easily carried and/or stored.

FIGS. 5 and 6 illustrate how the golf swing trainer 10 is used to simulate the portion of a golfer's swing just prior to and during impact. In FIG. 5, a golfer 70 is gripping the grip 12 in a conventional manner. The cord loop 14 is placed around the golfer's neck. The neck pad is not shown in these figures. In the position shown in FIG. 5, the golfer has moved from an address position to what may be described as a nine o'clock position or halfway point on the back swing. In this position, the golfer's wrists 72 are fully cocked or hinged, as they should be for a powerful swing.

In the position shown in FIG. 6, the golfer has moved from the half way back position of FIG. 5 to a position immediately after an impact position. In this position, the golfer's wrists 72 have fully uncocked or unhinged. Immediately after the position shown in FIG. 6, the golfer's wrists will fully release or roll through and forward as the golfer completes his swing. However, with the present invention, the golfer does not have to complete his swing to simulate proper wrist action. All that is necessary is for the golfer to move from the position shown in FIG. 5 to the position shown in FIG. 6, preferably repeatedly, all the while practicing cocking the wrists at the half way point and releasing the wrists just prior to impact position.

It is important that the golfer maintain tension in cord loop 14 all through the abbreviated swing motion shown in FIGS. 5 and 6. It is this cord tension that provides the force against which the golfer's wrists must act as the wrists are released. In other words, the cord loop tension should be less in the position of FIG. 5 than the position of FIG. 6. But there should always remain some tension in the cord loop at all times. In this manner, the uncocking of the wrists causes the cord loop to lengthen, thus increasing its tension.

FIGS. 7 and 8 illustrate the abbreviated swing motion of FIGS. 5 and 6 as seen from the right of the golfer. FIG. 7 shows the golfer 70 at a halfway back position and FIG. 8 shows the golfer 70 right at impact. These two views show how the cord loop gives the golfer an idea of the angle of the golfer's swing plane. Swing plane is generally the inclined plane in which the club head travels throughout the swing. This swing plane is generally centered about the golfer's neck or head. By extending the cord loop around the golfer's neck, the cord loop simulates the swing plane of the golfer. Should the golfer move outside of the swing plane on the downswing, this should be evidenced by the cord loop passing a noticeable distance above the golfer's wrists 72 at impact. As shown in FIG. 8, cord loop 14 is passing just over the golfer's wrists and is actually brushing the wrists. This indicates a swing plane aligned with a target. If there were a gap between cord loop 14 and wrists 72, chances are the golfer moved outside his intended swing plane, which tends to cause a slice or a pull.

A primary function of the present invention is to improve a golfer's wrist action. Wrist action is important for increasing driving distance. A golfer who uncocks his wrists early on the downswing will lose distance on his shots. Delayed uncocking of the wrists acts to increase distance because the club head speed is increased by the action of the wrists. A good example of a present day golfer who does a wonderful job of delaying the uncocking of his wrists is Tiger Woods. The June issue of Golf Digest discusses this aspect of Tiger Wood's swing. Practice with the present invention causes a golfer to delay uncocking of his wrists until just prior to impact.

Not only does proper wrist action improve driving distance, but it also helps improve a golfer's swing plane. Many golfers tend to hit a "slice" shot rather than a "draw." There are many well known reasons for this tendency. The present invention, by training a golfer to delay uncocking of his wrists, also causes the golfer to move the club to the inside on his take-away, and keep it on the inside on the downswing. This straightens out a slicer's swing plane.

The present invention should also improve a golfer's tempo and rhythym. An easy way for a golfer to mess up his tempo and rhythym is to try to swing hard and muscle the ball, which golfer's tend to do when attempting to increase distance. With the present invention, distance is increased through more efficient use of the wrists, which allows a golfer to swing more naturally and fluidly.

Other advantages achievable with the present invention include improved balance and weight shift. The present invention teaches a golfer to keep his weight behind the ball, in order to allow the wrists to uncock. In so doing, the present invention helps train a golfer to keep his left shoulder closed at impact, which improves balance, among other things.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. A golf swing training device, comprising:

a grip generally in the form of a golf club grip, and an elastic cord loop attached to a lower end of the grip, the elastic cord loop having sufficient flexibility and length to extend around a golfer's neck, while the grip is held by the golfer's hand in an address position with the lower end of the grip pointing downwardly away from the golfer, the elastic cord loop also having sufficient tension, which the golfer's hands must overcome as the device is utilized to simulate wrist action during a golf swing.

2. The golf swing training device of claim 1, wherein the grip is tapered and include a wider end and a narrower end, the elastic cord loop being attached to the narrower end.

3. The golf swing training device of claim 1, and further comprising a head attachment mounted at the lower end of the grip, the head attachment including a pair of openings sized slightly larger than the thickness of the cord loop, the cord loop having ends that are each adapted to be inserted through an opening and tie off.

4. The golf swing training device of claim 1, and further comprising a neck pad, the elastic cord loop adapted to be inserted through the neck pad and reattached to the grip.

5. The golf swing training device of claim 4, wherein the neck pad includes a sleeve for storing the grip and elastic cord loop.

6. A method of improving a golfer's swing, comprising the steps of gripping a golf club grip, extending an elastic cord loop around a golfer's neck, attaching the ends of the cord loop to one end of the grip, holding the grip at an address position, with the elastic cord loop attached at the lower end of the grip, and with the elastic cord loop having sufficient tension to resist further movement of the lower end of the grip away from the golfer's head, and simulating the portion of a golf swing before and after impact where the wrists of the golfer release, in a manner that the elastic cord loop retains tension therein throughout the swing.

7. The method of claim 6, including the step of maneuvering the grip through the swing in a manner that the elastic cord loop crosses over the golfer's wrists in close proximity thereto or by actually grazing the wrists.

* * * * *